US011664620B2

(12) United States Patent
Ripper et al.

(10) Patent No.: US 11,664,620 B2
(45) Date of Patent: May 30, 2023

(54) JOINT CONNECTION ASSEMBLY

(71) Applicant: TE Connectivity Germany GmbH, Bensheim (DE)

(72) Inventors: Hartmut Ripper, Bensheim (DE); Joerg Wagner, Bensheim (DE); Markus Fiebiger, Bensheim (DE); Zoran Stjepanovic, Bensheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 106 days.

(21) Appl. No.: 17/224,646

(22) Filed: Apr. 7, 2021

(65) Prior Publication Data

US 2021/0313728 A1 Oct. 7, 2021

(30) Foreign Application Priority Data

Apr. 7, 2020 (DE) ..... 10 2020 204 456.2

(51) Int. Cl.

| | |
|---|---|
| ***H01R 13/436*** | (2006.01) |
| ***H01R 13/52*** | (2006.01) |
| ***H01R 13/627*** | (2006.01) |
| ***H01R 13/639*** | (2006.01) |

(52) U.S. Cl.

CPC ..... *H01R 13/4362* (2013.01); *H01R 13/5205* (2013.01); *H01R 13/6271* (2013.01); *H01R 13/639* (2013.01)

(58) Field of Classification Search

CPC ..... H01R 31/085; H01R 13/4362; H01R 13/5205; H01R 13/839; H01R 31/08

See application file for complete search history.

(56) References Cited

U.S. PATENT DOCUMENTS

| | | | | | |
|---|---|---|---|---|---|
| 5,061,196 | A * | 10/1991 | Weston | H01R 31/08 | 439/189 |
| 5,112,239 | A * | 5/1992 | Yagi | H01R 31/08 | 439/189 |
| 5,201,667 | A * | 4/1993 | Endo | H01R 31/08 | 439/189 |
| 5,403,204 | A * | 4/1995 | Chishima | H01R 13/4223 | 439/189 |

(Continued)

FOREIGN PATENT DOCUMENTS

| | | |
|---|---|---|
| DE | 696 15 461 T2 | 6/2002 |
| DE | 11 2010 000 788 T5 | 6/2012 |
| DE | 11 2012 003 910 T5 | 7/2014 |

OTHER PUBLICATIONS

European Search Report, App. No. 21166998.1-1201, dated Sep. 2, 2021, 8 pages.

German Office Action, dated Dec. 16, 2020, 5 pages.

*Primary Examiner* — Neil Abrams

(74) *Attorney, Agent, or Firm* — Barley Snyder

(57) ABSTRACT

A connection assembly includes a first housing part, a second housing part pluggable with the first housing part, and a joint connector held between the first housing part and the second housing part. The first housing part has a plurality of contact element receptacles and a plurality of latching elements. The latching elements latch a plurality of contact elements in the contact element receptacles. The second housing part has a locking section locking one of the latching elements in a latching position. The joint connector connects at least two of the contact elements.

16 Claims, 9 Drawing Sheets

(56) References Cited

U.S. PATENT DOCUMENTS 5,433,628 A * 7/1995 Sadaishi ..... H01R 13/5202 439/736
5,769,650 A * 6/1998 Aoyama ..... H01R 13/4365 439/189
5,788,519 A 8/1998 Stern
6,146,174 A * 11/2000 Maeda ..... H01R 13/5219 439/271
6,171,140 B1 * 1/2001 Anbo ..... H01R 13/7032 439/516
6,840,820 B2 * 1/2005 Oda ..... H01R 13/518 439/724
7,335,054 B2 * 2/2008 Nakazawa ..... H01R 31/08 439/511
8,083,543 B2 * 12/2011 Omori ..... H01R 31/08 439/511
8,182,286 B2 5/2012 Tamagawa et al.
8,337,251 B2 * 12/2012 Ecker ..... H01R 31/08 439/620.27
8,992,259 B2 * 3/2015 Miwa ..... H01R 13/7193 439/620.05
9,083,094 B2 * 7/2015 Teramoto ..... H01R 4/64
9,099,803 B2 * 8/2015 Omori ..... H01R 13/521
9,211,852 B2 12/2015 Omori et al.
9,318,827 B2 * 4/2016 Osada ..... H01R 13/4223
9,362,665 B2 * 6/2016 Omori ..... H01R 31/085
9,761,978 B2 * 9/2017 Kim ..... H01R 13/73
9,825,375 B2 * 11/2017 Naganishi ..... H01R 11/09
9,922,755 B2 * 3/2018 Matsui ..... H01B 11/125
10,483,675 B2 * 11/2019 Nishiyama ..... H01R 31/08
10,714,860 B2 * 7/2020 Washio ..... B60R 16/0207
2004/0248449 A1 12/2004 Martin
2014/0011389 A1 * 1/2014 Shinmi ..... H01R 13/62 439/370
2014/0134869 A1 * 5/2014 Hamai ..... H01R 13/62 439/345
2015/0340790 A1 * 11/2015 Hamai ..... H01R 13/4223 439/660
2017/0250504 A1 * 8/2017 Bang ..... H01R 11/09
2019/0140389 A1 5/2019 Yi et al.
2021/0313728 A1 * 10/2021 Ripper ..... H01R 13/5205

* cited by examiner

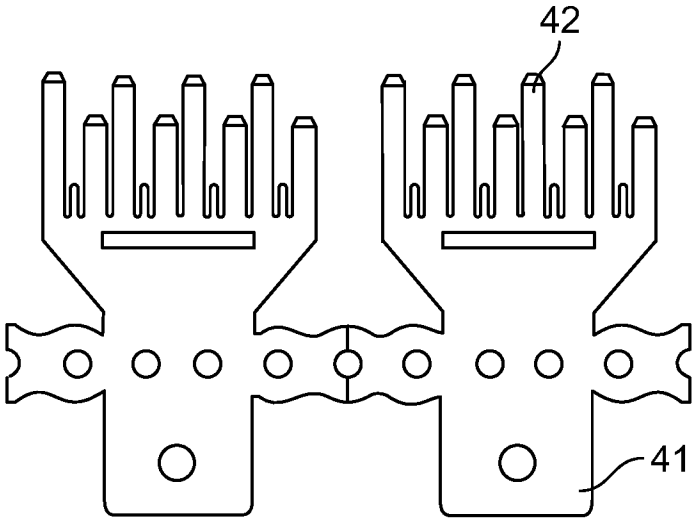
Fig. 10
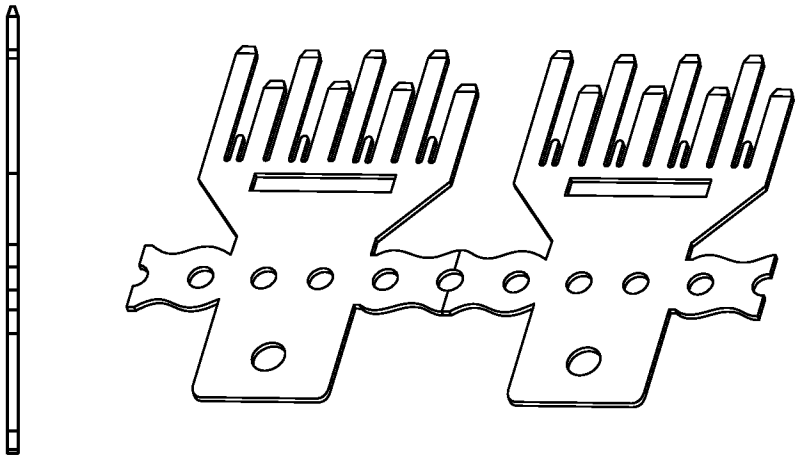
Fig. 11
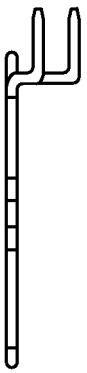
Fig. 12
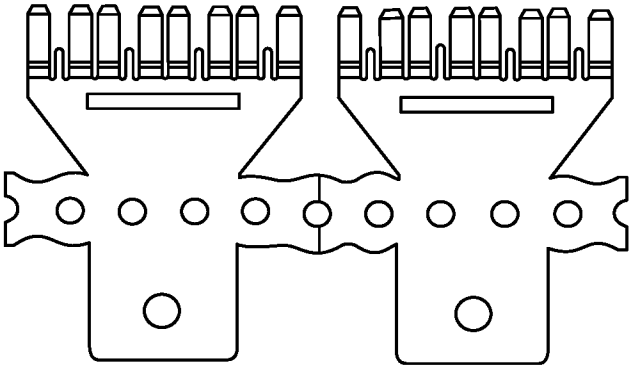
Fig. 13
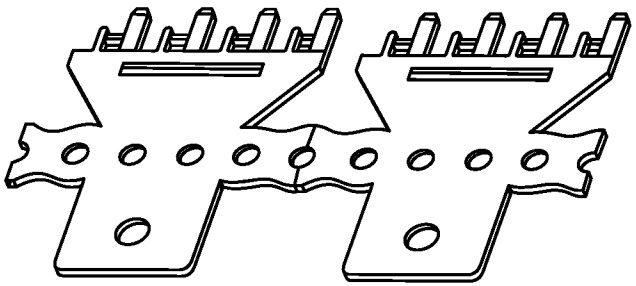
Fig. 14
Fig. 15

JOINT CONNECTION ASSEMBLY

CROSS-REFERENCE TO RELATED APPLICATIONS

This application claims the benefit of the filing date under 35 U.S.C. § 119(a)-(d) of German Patent Application No. 102020204456.2, filed on Apr. 7, 2020.

FIELD OF THE INVENTION

The present invention relates to a connection assembly and, more particularly, to a connection assembly having a first housing part and a second housing part configured to be plugged together with the first housing part.

BACKGROUND

A connection assembly has a first housing part and a second housing part configured to be plugged together with the first housing part. Known connection assemblies, however, are not sufficiently secure.

SUMMARY

A connection assembly includes a first housing part, a second housing part pluggable with the first housing part, and a joint connector held between the first housing part and the second housing part. The first housing part has a plurality of contact element receptacles and a plurality of latching elements. The latching elements latch a plurality of contact elements in the contact element receptacles. The second housing part has a locking section locking one of the latching elements in a latching position. The joint connector connects at least two of the contact elements.

BRIEF DESCRIPTION OF THE DRAWINGS

The invention will now be described by way of example with reference to the accompanying Figures, of which:

FIG. 10 shows a schematic top view of a step of manufacturing parts of the connection assembly;

FIG. 11 shows a schematic side view of the manufacturing step of FIG. 10;

FIG. 12 shows a schematic perspective view of the manufacturing step of FIG. 10;

FIG. 13 shows a schematic top view of a step of manufacturing parts of the connection assembly;

FIG. 14 shows a schematic side view of the manufacturing step of FIG. 13;

FIG. 15 shows a schematic perspective view of the manufacturing step of FIG. 13;

DETAILED DESCRIPTION OF THE EMBODIMENT(S)

In the following, the invention shall be described by way of example in detail with reference to the drawings using advantageous configurations. The advantageous developments and configurations illustrated are each independent of each other and can be combined with one another.

A connection assembly 100 according to an embodiment is shown in FIGS. 1-9. The connection assembly 100 serves to establish the same electrical potential on different lines, which for this purpose are connected via contact elements 12 to a joint connector 40, or synonymously a comb connector.

Figure 2:
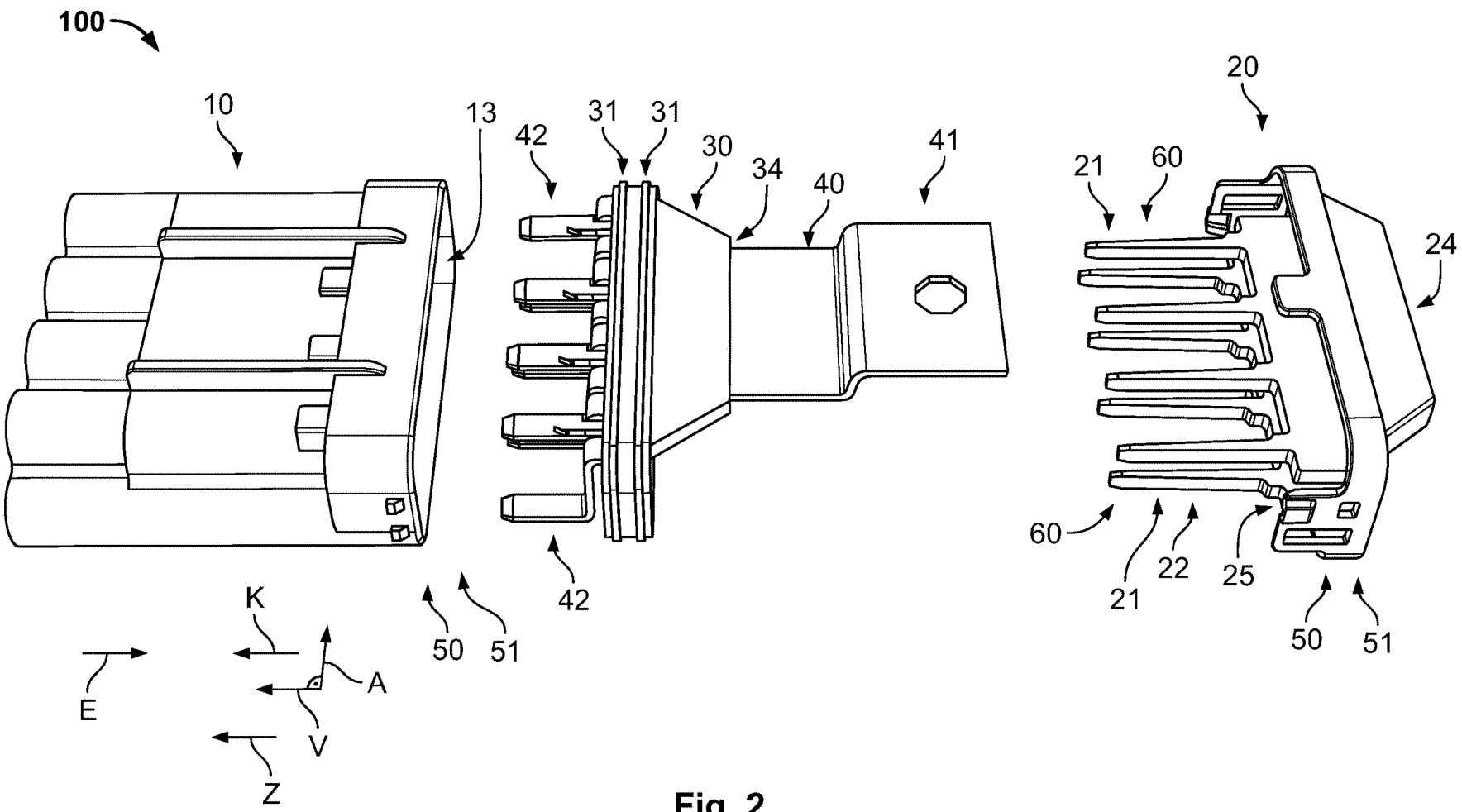
FIG. 2 shows a schematic exploded view of the embodiment from FIG. 1.
Figure 8:
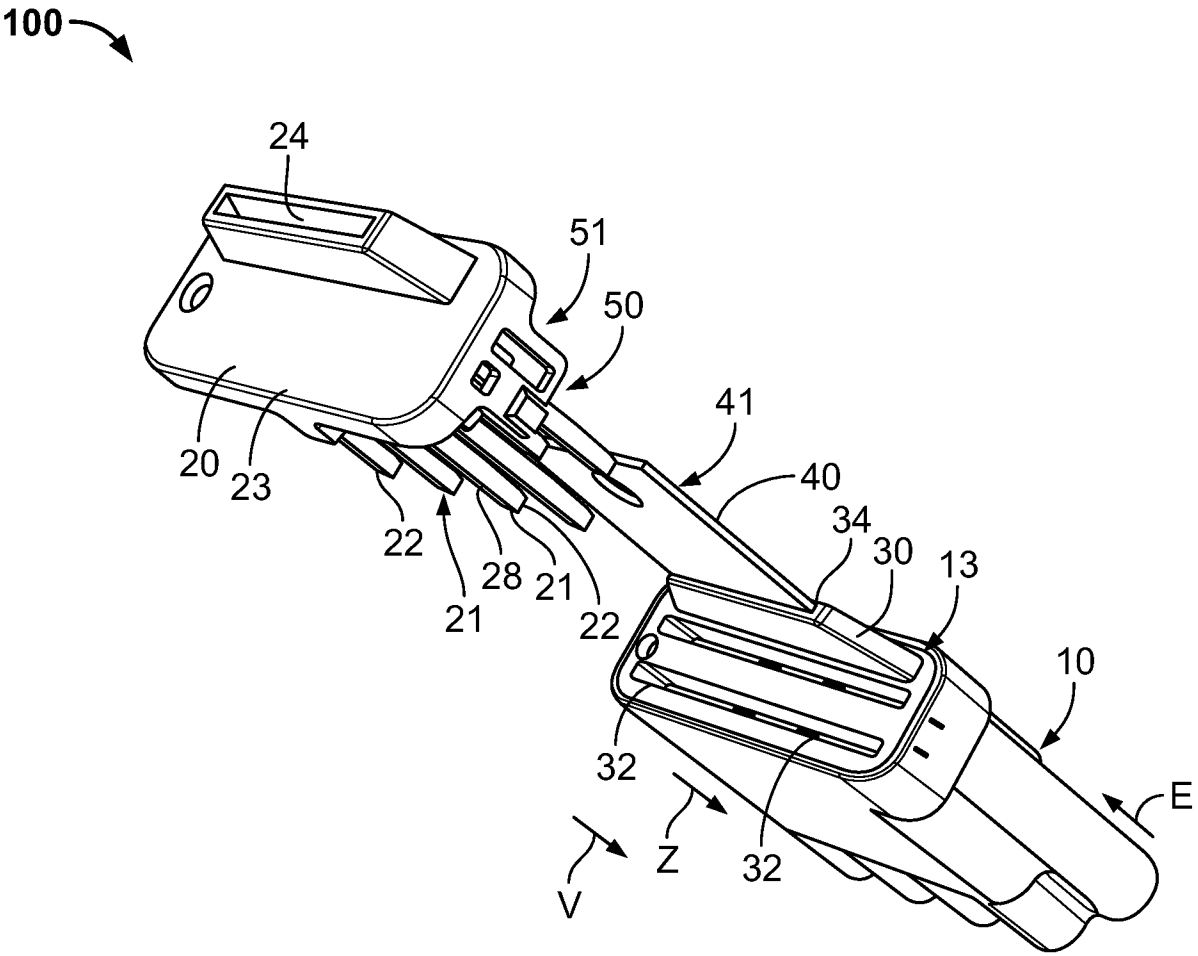
FIG. 8 shows a schematic exploded perspective view of the first embodiment from a different viewing direction.
Figure 9:
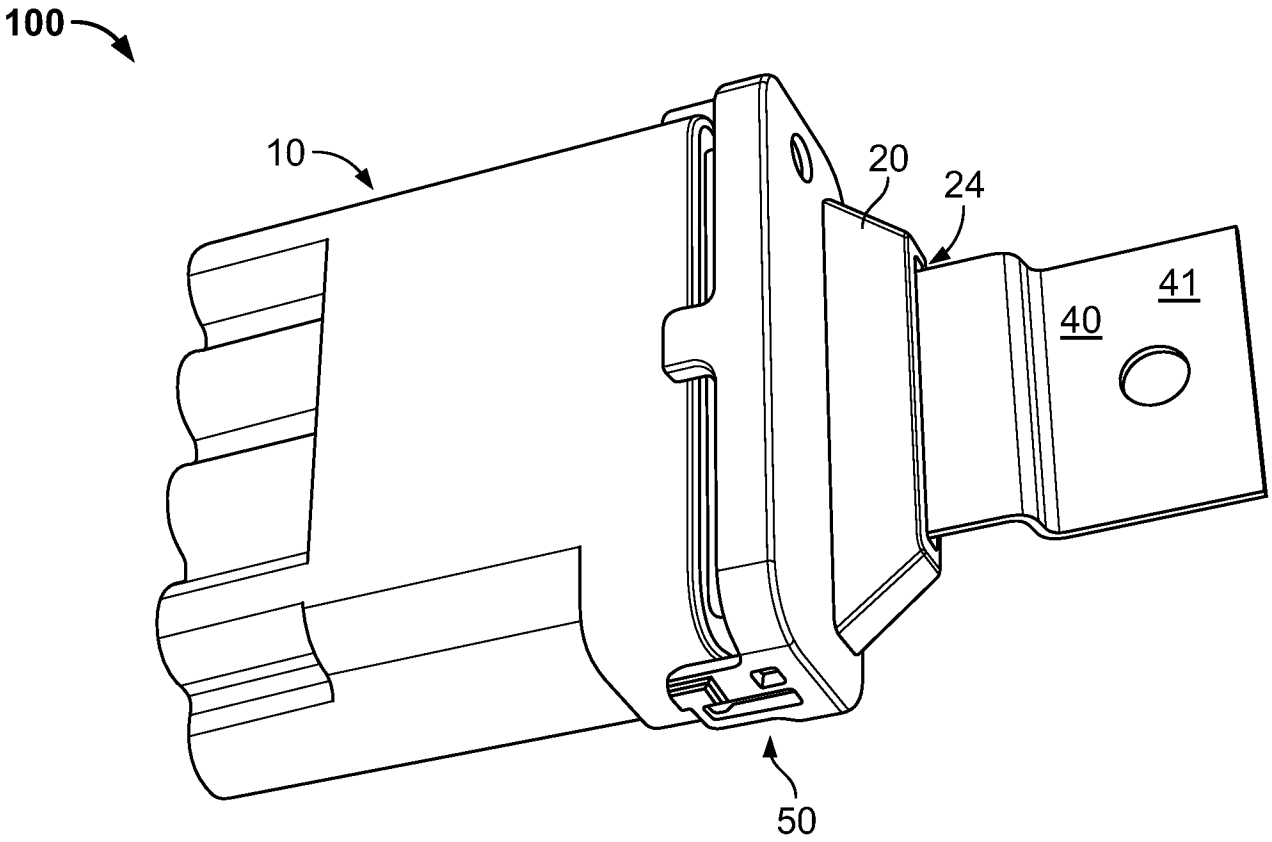
FIG. 9 shows a schematic perspective view of the first embodiment from a further viewing direction.
Figure 18:
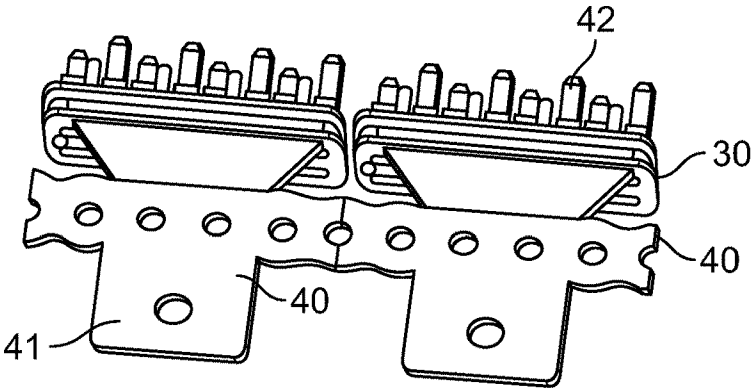
FIG. 18 shows a schematic perspective view of the manufacturing step of FIG. 16.
Figure 17:
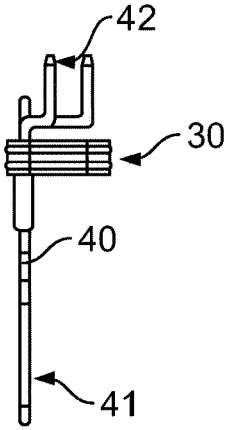
FIG. 17 shows a schematic side view of the manufacturing step of FIG. 16.
Figure 16:
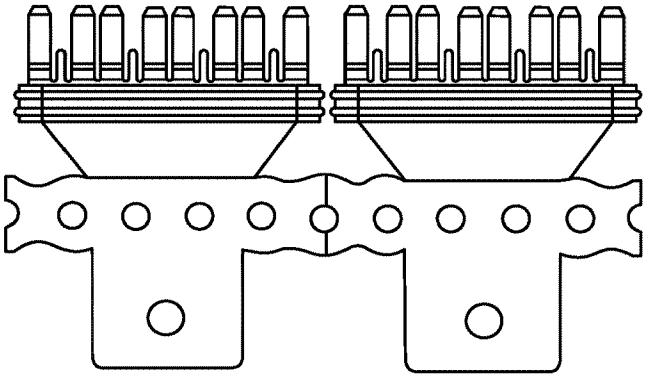
FIG. 16 shows a schematic top view of a step of manufacturing parts of the connection assembly.

As shown in FIGS. 2, 8, and 9, the joint connector 40 comprises, in an embodiment, a single metal part that has a connection section 41 with which external contacting is possible, for example, in order to establish a connection to ground, and a contact section 42.

The connection assembly 100 comprises a first housing part 10 that comprises contact element receptacles 11 for contact elements 12 and latching elements 14 for latching of contact elements 12 in contact element receptacles 11, as shown in FIGS. 1 and 3-7. Latching elements 14 are each configured as a projection 60 in the form of an arm 15 which at a fixed end is connected integrally to the remainder of first housing part 10 and can be resiliently deflected at a free end. The latching element 14 in a force-free state projects into contact element receptacle 11. When inserting a contact element 12 along a direction of insertion E, the free end of latching element 14 is deflected along a direction of deflection A which runs perpendicular to direction of insertion E. When the end position of contact element 12 has been reached in contact element receptacle 11, latching element 14 latches automatically and thereby secures contact element 12 in contact element receptacle 11.

Figure 1:
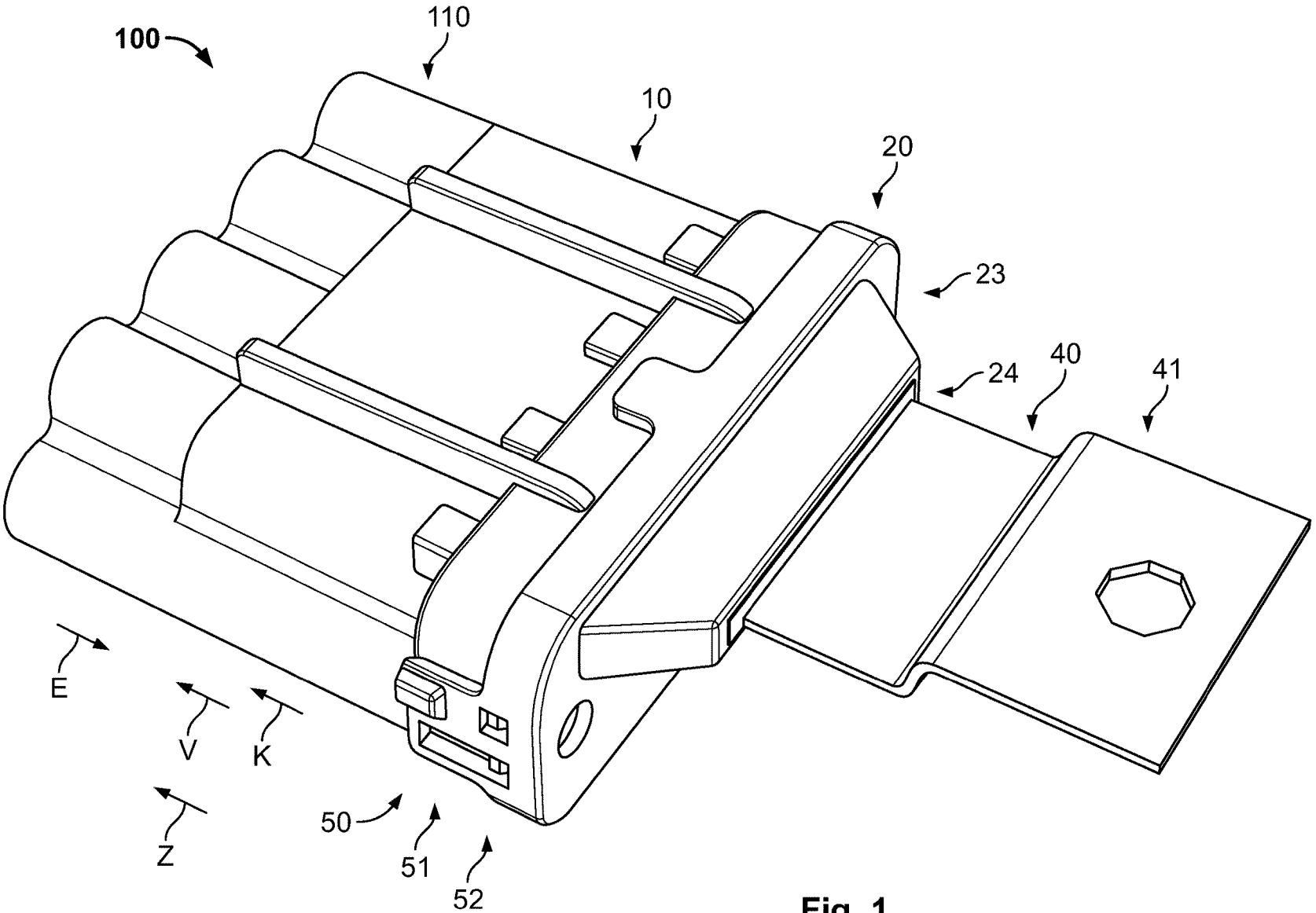
FIG. 1 shows a schematic perspective view of a first embodiment of a connection assembly.

Connection assembly 100 has a second housing part 20 which can be plugged together with first housing part 10 along a plugging direction Z and then forms a housing 110, as shown in FIG. 1. In the plugged state, joint connector 40 is held between first housing part 10 and second housing part 20. If contact elements 12 are plugged in, then joint connector 40 connects these contact elements 12 to one another in an electrically conductive manner. The joint connector 40 can contact several contact elements 12 with the contact section 42, for example, to make them assume the same potential.

Figure 5:
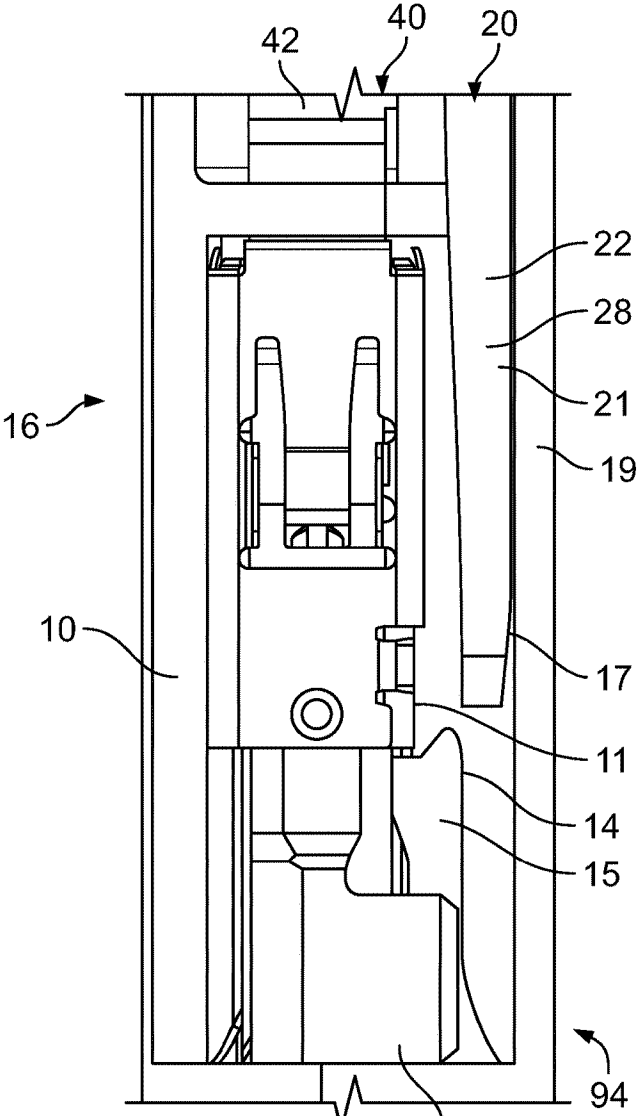
FIG. 5 shows a detailed view of FIG. 4.
Figure 7:
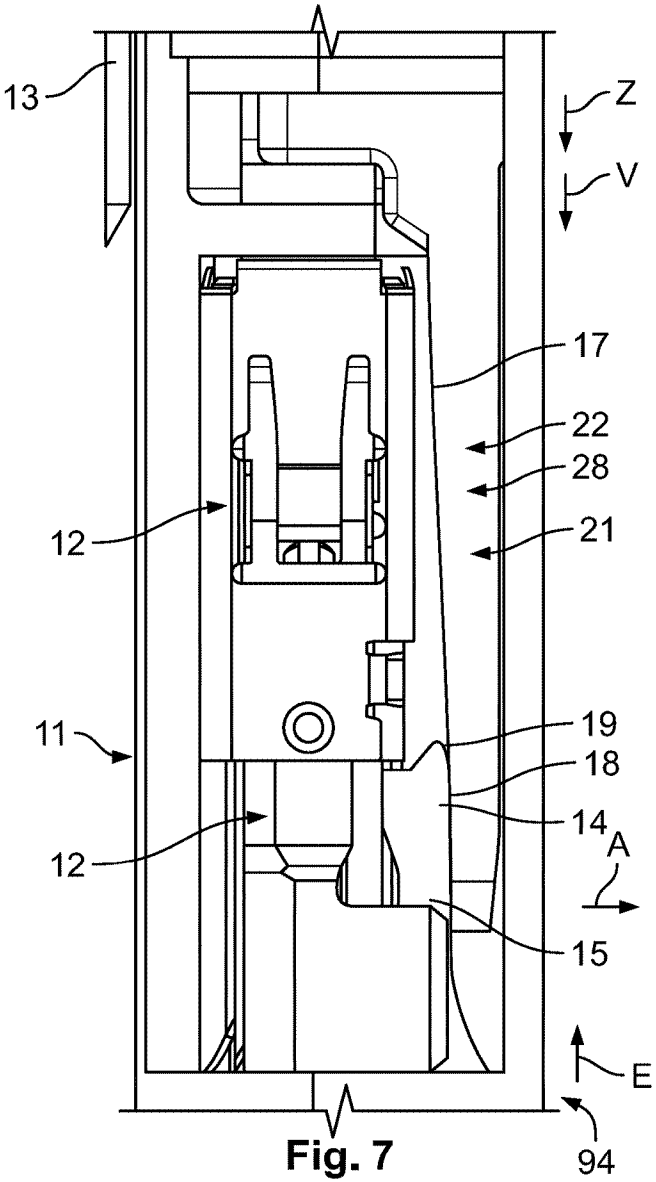
FIG. 7 shows a detailed view of FIG. 6.
Figure 6:
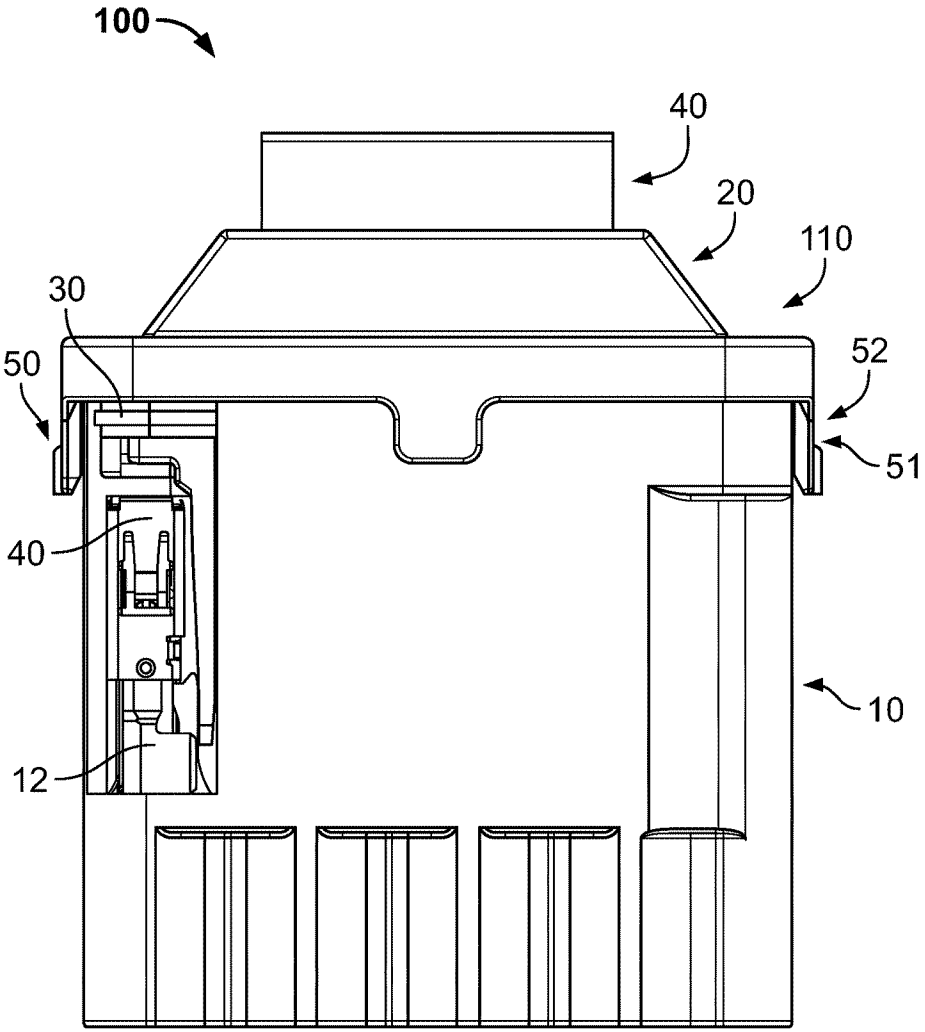
FIG. 6 shows a schematic, partially sectioned side view of the embodiment from FIG. 1.

In the embodiment shown in FIGS. 2, 5, and 7, second housing part 20 comprises several locking sections 21, where a respective locking section 21 locks a latching element 14 in a latching position 94. Latching position 94 is the position in which latching element 14 secures contact element 12 in contact element receptacle 11. In the example shown, a respective latching element 14 is associated with a contact element 12 and a contact element receptacle 11. In other embodiments, several contact elements 12 can be secured with a latching element 14 and/or a locking section 21 can be used for several contact elements 12 and/or latching elements 14. Due to the lock, the contact elements 12 cannot come loose and the connection assembly 100 is more secure.

The latching elements 14 in a force-free state can protrude into the contact element receptacles 11; they can be deflectable such that they do not protrude or protrude less into the contact element receptacles 11 in the deflected state. This enables automatic latching. The latching elements 14 can be deflected by the contact elements 12 during insertion and can latch with the contact elements 12 when the latter are completely inserted.

Figure 3:
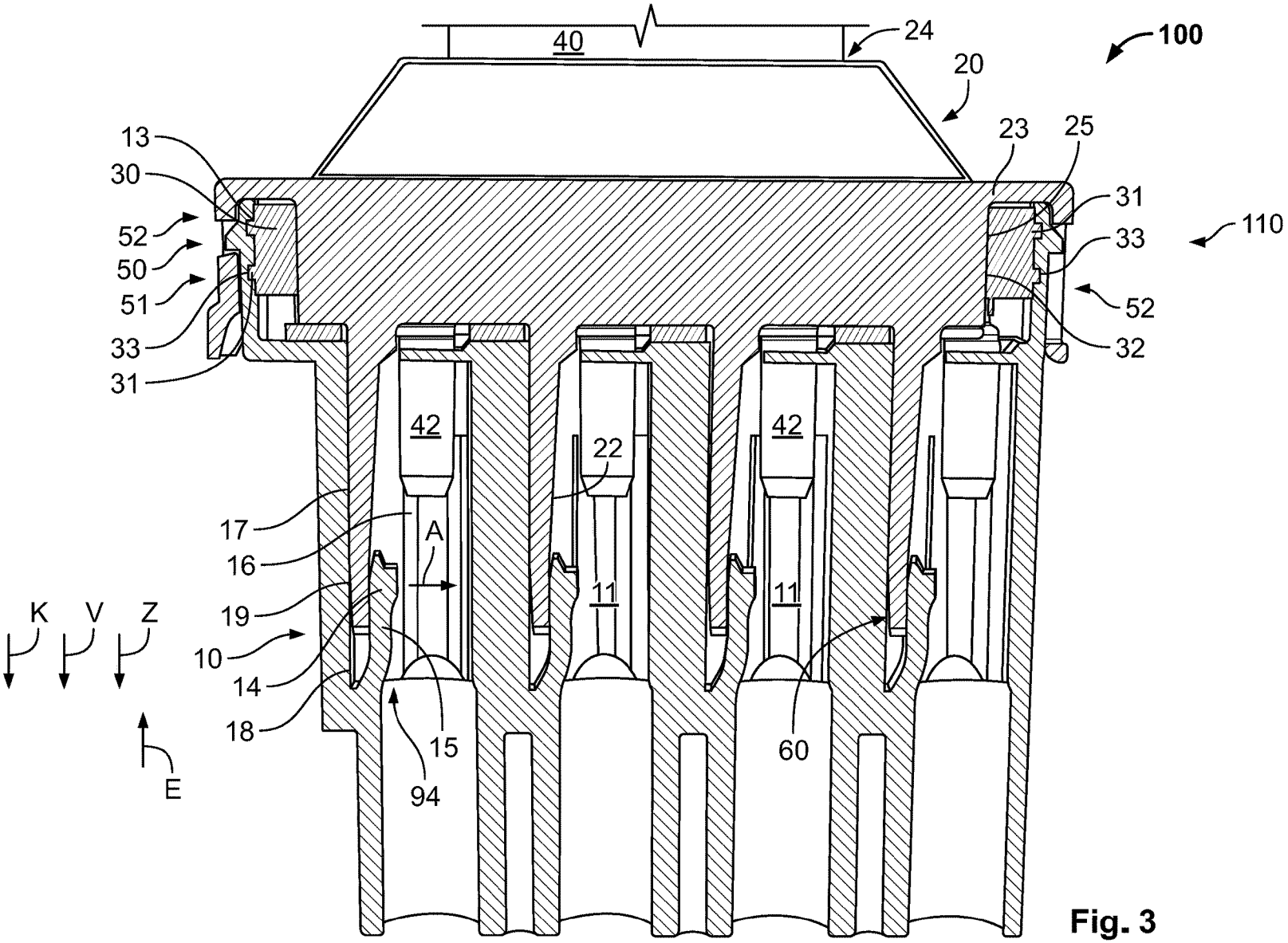
FIG. 3 shows a schematic sectional view through the embodiment from FIG. 1.

Locking sections 21 are each configured as projections 22 which project with respect to a base plate 23 of second housing part 20, as shown in FIGS. 2 and 3. In the example shown, several locking sections 21 are arranged on a common base 25, which in turn protrudes from the base plate 23. Locking sections 21 are configured as arms 28, as shown in FIGS. 5 and 7, which become narrower in a direction away from base plate 23, i.e. taper and are wedge-shaped. The locking section 21 can be configured, for example, as an arm 28 or strip in order to be particularly space-saving. The arm 28 or strip can be fixed at one end and movable at another end.

When housing parts 10, 20 are plugged together, locking sections 21 extend from second housing part 20 into first housing part 10. Each locking section 21 is disposed at least in part adjacent to a contact element receptacle 11. When viewed from second housing part 20, each locking section 21 extends beyond first half 16 of the contact element receptacle 11 facing second housing part 20, as shown in FIG. 5.

First housing part 10 comprises several receptacles 18 each receiving a free end of locking section 21, as shown in FIG. 3. In the plugged state, parts of locking sections 21 are disposed in receptacles 18 and block a deflection of associated latching elements 14 in a positive-fit and/or a mechanical manner. Locking section 21 is there arranged between latching element 14 and a wall section 19 of first housing part 10. The locking section 21 can abut against the latching element 14 and the wall section 19 and mechanically block a motion of the latching element 14 towards the wall section 19. The locking section can be supported by the wall section 19.

In the plugged state, locking sections 21 are each located in a slot 17 in first housing part 10. Slot 17 runs parallel to contact element receptacle 11. The slot 17 can be complementary at least in part to the locking section 21. The slot 17 and the contact element receptacle 11 can each be configured as elongate cavities, for which the extension in one direction is significantly greater than in the other directions by about a factor of 2 or more.

Receptacles 18 are each disposed behind associated latching element 14, i.e. are defined by latching element 14 and wall section 19, as shown in FIG. 3. Latching element 14 is functionally disposed between contact element 12 and locking section 21 of second housing part 20. At the same time, contact element 12 is disposed between latching element 14 and a base plate 23 of second housing part 20. The latching element 14 can be locked when the part of the locking section 21 is received in the receptacle 18.

Locking sections 21 are each connected integrally to the remainder of second housing part 20, as shown in FIGS. 2 and 3.

Figure 4:
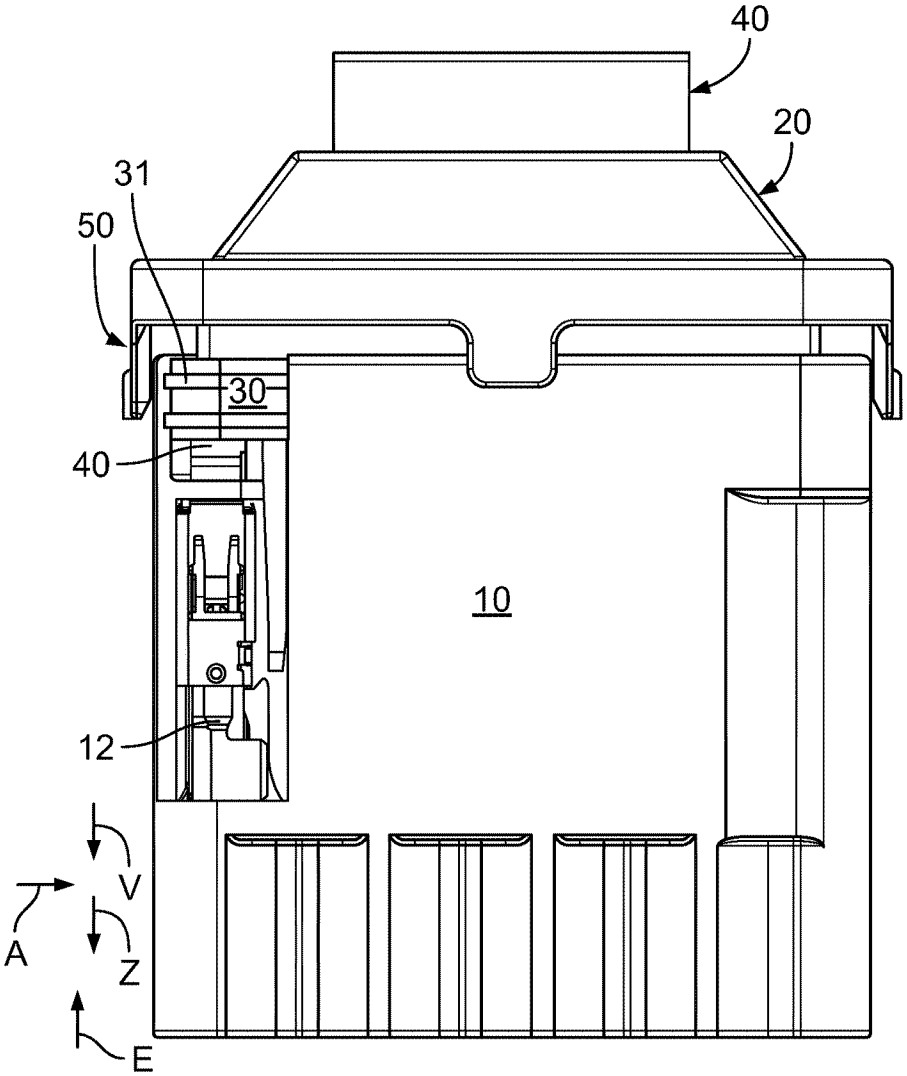
FIG. 4 shows a schematic, partially sectioned side view of the embodiment from FIG. 1.

Connection assembly 100 further comprises a sealing element 30 which can be inserted into first housing part 10, as shown in FIGS. 2-4. Locking sections 21 extend through sealing element 30. For this purpose, sealing element 30 comprises passage holes 32, shown in FIGS. 3 and 8, which, in particular, receive common bases 25 in a sealing manner. The sealing element 30 can be made of flexible, in particular compressible material or comprise such a material for obtaining a good seal. The sealing element 30 can seal in the region of the common base 25 in order to keep the sealing surface smaller than in the case of separately sealing several locking sections 21. For this purpose, the sealing element 30 can comprise a single passage hole 32 for the common base 25.

Joint connector 40 likewise extends through sealing element 30, as shown in FIG. 2. Joint connector 40 furthermore extends through second housing part 20, which comprises a passage hole 24 for this purpose as shown in FIG. 3. Joint connector 40 is connected to sealing element 30 by way of injection molding. During the manufacturing process, sealing element 30 is injected around joint connector 40, as a result of which passage hole 34 is created automatically. Joint connector 40 is then embedded into sealing element 30 at least in part. The connection section 41 protrudes from the first housing part 10.

First housing part 10 and/or second housing part 20 in the assembled state can exert pressure upon sealing element 30 in order to compress it and thereby obtain a good sealing effect. A sealing element receptacle 13 in first housing part 10, shown in FIG. 2, can be smaller than sealing element 30 in order to automatically compress it. When plugged together, second housing part 20 can furthermore generate pressure and compress sealing element 30. Two closed circumferential projections 31 on sealing element 30 interact with closed circumferential recesses 33 on first housing part 10, so that sealing element 30 is held in a positive-fit sealing manner.

Connection assembly 100 furthermore comprises an attachment mechanism 50 in the form of a latching mechanism 51 with which second housing part 20 can be attached to first housing part 10, as shown in FIGS. 1-3. In a latching position 52, in which first housing part 10 is latched to second housing part 20, second housing part 20 automatically locks latching elements 14 by way of locking elements 21.

A direction of insertion E shown in FIG. 1, along which contact elements 12 are plugged into contact element receptacles 11, is anti-parallel to a locking direction V along which locking sections 21 can be displaced relative to contact element receptacles 11. A plugging direction Z, along which second housing part 20 is plugged together with first housing part 10, is also anti-parallel to direction of insertion B and parallel to a direction of compression K, along which second housing part 20 exerts pressure upon sealing element 30. Second housing part 20 is arranged on a side of first housing part 10 which is disposed opposite to a side at which contact elements 12 are inserted. Handling is easier if at least two of the directions V, Z, B, and K run parallel or anti-parallel. With such configurations, in particular transverse forces which can lead to damage or make operation more difficult can be prevented or reduced.

The manufacture of a part of the connection assembly 100 is shown in FIGS. 10 to 18. After a corresponding piece of the joint connector 40 has been punched out of a sheet of metal, it is bent to enable contacting in different planes, as shown in FIGS. 10 to 15. In a subsequent step, shown in FIGS. 16-18, the sealing element 30 is molded or sprayed onto joint connector 40 that has been created.

What is claimed is:

1. A connection assembly, comprising:

a first housing part having a plurality of contact element receptacles and a plurality of latching elements, the latching elements latching a plurality of contact elements in the contact element receptacles;

a second housing part pluggable with the first housing part, the second housing part having a locking section locking one of the latching elements in a latching position; and a joint connector separate from the first housing part and the second housing part and held between the first housing part and the second housing part, the joint connector connecting at least two of the contact elements.

2. The connection assembly of claim 1, wherein the locking section is a projection.

3. The connection assembly of claim 1, wherein the locking section blocks a motion of the one of the latching elements out of the latching position.

4. The connection assembly of claim 1, wherein the first housing part has a receptacle receiving a part of the locking section.

5. The connection assembly of claim 1, wherein the latching elements project into the contact element receptacles.

6. The connection assembly of claim 1, wherein the locking section is integrally connected to a remainder of the second housing part.

7. The connection assembly of claim 1, wherein the joint connector has a connection section protruding from the first housing part.

8. The connection assembly of claim 1, further comprising a sealing element inserted into the first housing part.

9. The connection assembly of claim 8, wherein the locking section extends through the sealing element.

10. The connection assembly of claim 8, wherein the joint connector extends through the sealing element.

11. The connection assembly of claim 8, wherein the sealing element is at least in part sprayed or molded onto the joint connector.

12. The connection assembly of claim 8, wherein the second housing part exerts pressure on the sealing element.

13. The connection assembly of claim 1, further comprising an attachment mechanism with which the second housing part can be attached to the first housing part.

14. The connection assembly of claim 13, wherein the attachment mechanism is a latching mechanism that latches the first housing part to the second housing part in a latching position.

15. The connection assembly of claim 14, wherein the second housing part locks the latching element when the latching mechanism is in the latching position.

16. The connection assembly of claim 1, wherein at least two of the following directions run in parallel or anti-parallel:

a direction of insertion along which the contact elements are inserted into the contact element receptacles;

a plugging direction along which the second housing part is plugged together with the first housing part;

a locking direction along which the locking section is displaceable relative to the contact element receptacles; and a direction of compression along which the second housing part exerts pressure upon the sealing element.

* * * * *